US005913612A

United States Patent [19]

Turner

[11] Patent Number: 5,913,612

[45] Date of Patent: Jun. 22, 1999

[54] REPLACEABLE TOILET TANK COVER

[75] Inventor: James R. Turner, Florence, S.C.

[73] Assignee: J Ray Manufacturing, Florence, S.C.

[21] Appl. No.: 09/032,201

[22] Filed: Feb. 27, 1998

[51] Int. Cl.[6] ..... E03D 1/00

[52] U.S. Cl. ..... 4/353; 220/323; 292/76

[58] Field of Search ..... 4/353; 220/323, 220/780; 292/76

[56] References Cited

U.S. PATENT DOCUMENTS

| | | | |
|---|---|---|---|
| 1,434,732 | 11/1922 | Boyle | 292/76 |
| 1,936,008 | 11/1933 | Cowan | 4/353 |
| 2,065,908 | 12/1936 | Pihl | 292/76 |
| 2,133,789 | 10/1938 | Pool | 220/323 |
| 2,170,776 | 8/1939 | Goepel | 4/353 |
| 2,506,480 | 2/1950 | Bachli et al. | 4/353 |
| 2,573,984 | 11/1951 | Parker et al. | 4/353 |
| 3,760,428 | 9/1973 | Korol | 4/353 |
| 4,162,548 | 7/1979 | Groombridge et al. | 4/353 |

*Primary Examiner*—Charles E. Phillips
*Attorney, Agent, or Firm*—Dority & Manning, P.A.

[57] ABSTRACT

A replaceable toilet tank cover is provided having a base member with a top surface and a bottom surface. A lip is defined around the sides of the cover. At least two post members are disposed on the bottom surface and are set off from the lip a predetermined distance so that a tank wall of the toilet tank can fit between the post members and the lip. A resilient retaining device is disposed on the bottom surface adjacent from and set off from the lip. The retaining device has at least two spring arms resiliently movable in a plane generally parallel to the bottom surface for resiliently pressing against the inside surface of the toilet tank wall thereby clamping the tank wall between the lip and the spring arms.

8 Claims, 2 Drawing Sheets

REPLACEABLE TOILET TANK COVER

BACKGROUND OF THE INVENTION

The present invention relates to a toilet tank cover, and more particularly to a plastic replaceable tank cover.

Conventional toilets are formed of relative heavy and expensive ceramic and similar materials. The tank covers are formed conventionally of the same material. As is commonly known, the tank covers must be removed for various reasons, including servicing the tank components, etc. Inevitably, the tank covers are broken and must be replaced. Tank covers formed of the same ceramic type material are relatively expensive and quite heavy. In this regard, the conventional covers also pose a safety threat in that they can cause serious bodily harm if dropped on a foot or hand.

Additionally, in certain environments or situations, tank covers have become a favorite object for vandals to randomly destroy or deface. It is a relatively expensive practice to continuously replace the tank covers with conventional covers.

Various attempts have been made in the art to provide plastic tank covers to eliminate some of the shortfalls mentioned above. One such example of a prior art plastic tank cover is manufactured and sold by Chicago Specialty Manufacturing Company of Wheeling, Ill. This prior art tank cover has a downwardly extending lip and a spring mechanism disposed on the underside thereof along one of the sides. The spring mechanism is a U-shaped resilient member that is fixed on one end to the bottom of the cover and has a free resilient end that presses against the tank wall. Applicant has found this particular prior art tank cover to have undesirable characteristics. For example, the tank cover does not securely seat on the tank and, due to its light weight, has a tendency to wobble or twist relative to the tank. Also, the tank is not sturdy and tends to "give" if heavy objects are placed on the cover.

Accordingly, it would be desirable in the art to have an improved lightweight or plastic replaceable tank cover that overcomes the deficiencies noted with such prior art devices.

OBJECTS AND SUMMARY OF THE INVENTION

It is a principal object of the present invention to provide an improved lightweight replaceable toilet tank cover.

Additional objects and advantages of the invention will be set forth in part in the following description, or may be obvious from the description, or may be learned through practice of the invention.

In accordance with the objects and purposes of the invention, a lightweight replaceable toilet tank cover is provided for closing an open side of a toilet tank, as generally understood in the art. The inventive tank cover includes a base member having a top surface and a bottom surface, and a lip defined around the sides thereof. At least two post members are disposed on the bottom surface and set off from the lip at a predetermined distance so that the wall of the toilet tank can fit between the post members and the lip when the cover is placed on top of the tank. A resilient retaining device is disposed on the bottom surface adjacent and set off from the lip. The retaining device comprises at least two spring arms that are resiliently movable in a plane generally parallel to the bottom surface of the tank for resiliently pressing against an inside surface of the toilet tank wall thereby clamping the tank wall between the lip and the spring arms.

Preferably, the base member is formed of a lightweight and inexpensive plastic material. In order to structurally reinforce the base member, it is preferred that a plurality of stiffening members are defined on the bottom or underside of the tank cover.

Preferably, the post members are disposed along the same side of the bottom surface, for example along the same long side, and the retaining device is disposed adjacent the opposite side of the bottom surface, for example on the opposite long side of the tank cover.

The spring arms of the retaining device may be mounted at a pivot point to a rigid base member that is attached to the bottom surface of the tank. The spring arms are resiliently movable in a radial plane relative to the pivot point. In this manner, the spring arms not only press against the tank wall, but also impart a twisting force to the tank cover. The spring arms may comprise an arcuate face disposed to contact the toilet tank wall so that the tank cover can be used with toilet tanks having varying thickness walls.

Preferably, the resilient retaining member is offset from a centerline that extends transverse to the long sides of the cover. Thus, since different lengths of cover extend beyond the pivot points of the adjacently disposed spring arms, a slight twisting torque is imparted to the cover. This twisting torque aids in maintaining the cover securely on the tank and preventing the cover from moving relative to the tank. Also in this regard, the post members disposed on the opposite side of the tank from the retaining device further secure the cover to the tank by preventing the cover from twisting. The post members are set off a distance from the retaining device such that the retaining device not only clamps on the tank wall, but also pushes the post members against the inner surface of the opposite tank wall thereby further securing the cover.

Additional characteristics, features, and objects of the invention will be set forth in more detail in the following description.

DETAILED DESCRIPTION OF THE PREFERRED EMBODIMENT

Figure 1:
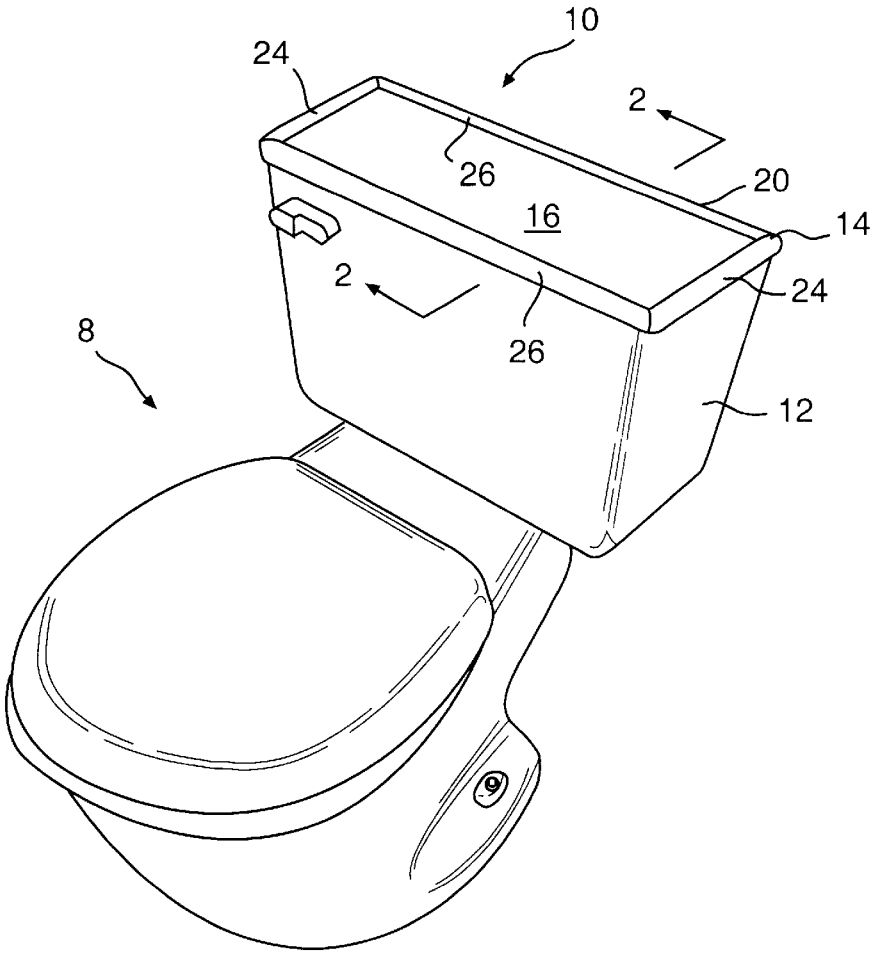
FIG. 1 is a perspective view of a toilet incorporating the inventive tank cover.

Reference will now be made in detail to the presently preferred embodiments of the invention, one or more examples of which are illustrated in the drawings. Each example is provided to explain the invention, and is not meant as a limitation of the broader aspects of the invention. For example, features illustrated or described as part of one embodiment can be used in another embodiment to yield a still further embodiment. It is intended that the present description cover such modifications and variations as come within the scope and spirit of the invention.

Referring to FIG. 1, a conventional toilet 8 is illustrated with a tank cover 10 according to the invention. Cover 10 has long sides 26 and short sides 24. However, it should be understood that tank cover 10 need not necessarily be rectangular in shape. For example, many designer style toilets have other than rectangular toilet tanks, and the present tank cover is just as applicable to such toilets.

Cover 10 has a base member, generally 14. Base member 14 includes the top surface 16 and a bottom surface 18, as well as a lip 20 extending around the circumference of the cover and extending generally down from bottom surface 18. Preferably, base member 14 is formed of a lightweight and relatively inexpensive plastic or similar material. The present invention is not, however, limited to any particular type of material. In order to structurally reinforce base member 14, and the cover 10 in general, a plurality of stiffening members or ridges 44 may be provided on underside 18 of cover 10. Members 44 may be integrally molded with base member 14, or may comprise separate components attached or fixed to cover 10. The stiffening members 44 provide cover 10 with transverse and longitudinal stability so that the cover can support relatively heavy objects without bowing or giving.

Figure 2:
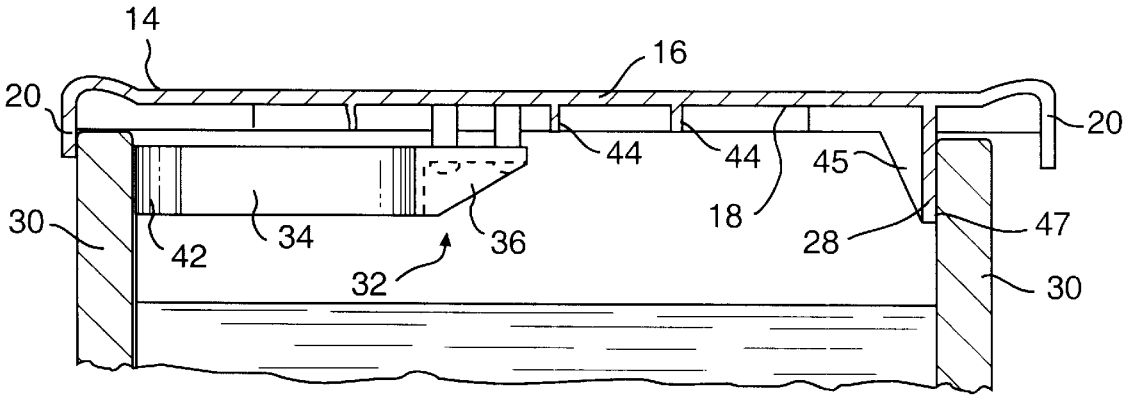
FIG. 2 is a cross-sectional view of the tank cover shown in FIG. 1 taken along the lines indicated.

Cover 10 includes at least two post members 28 extending generally from bottom side 18. Post members 28 are disposed and set off from lip 20 a predetermined distance sufficient for a tank wall of the toilet tank to fit between the post member 28 and lip 20, as illustrated in FIG. 2. In a preferred embodiment illustrated in FIG. 3, post members 28 are disposed along the same long side 26. Post members 28 may comprise perpendicularly extending members having a flat side 47 disposed facing lip 20, as illustrated in FIG. 2, and supported by a stiffening member 45 on the opposite side thereof. Side 47 is relatively flat to positively contact and seat against the inside surface of tank wall 30. A sufficient distance is defined between lip 20 and post 28 so that the cover can accommodate tanks having various wall thicknesses. It should also be understood that a plurality of the post members can be disposed around the circumference of cover 10.

Cover 10 also includes a resilient retaining device, generally 32. Device 32 is disposed also on bottom surface 18 adjacent and set off from lip 20. Preferably, device 32 is disposed along long side 26 opposite from post members 23, as illustrated particularly in FIG. 3. Retaining device 32 includes at least two spring arms 34 that are resiliently movable in a plane generally parallel to bottom surface 18. Referring again to FIG. 3, spring arms 34 are connected to a rigidly mounted base 36 at a pivot point 40. Arms 34 move in a radial plane relative to pivot point 40 towards and away from lip 20. The rigid base 36 can be attached to surface 18 by any conventional manner, such as with screws 38. Spring arms 34 also may include arcuate wall contacting surfaces 42.

When cover 10 is placed on top of tank walls 30, as illustrated in FIG. 2, spring arms 34 pivot relative to points 40 and apply a compressive force to the inside of tank wall 30 thereby sandwiching wall 30 between lip 20 and arcuate contacting surfaces 42. At the same time, retaining device 32 also forces cover 10 towards the opposite tank wall 30 thereby pressing surfaces 47 of post members 28 against the opposite tank wall 30. Thus, the cover 10 is held against walls 30 at at least four positive contacting points.

Figure 3:
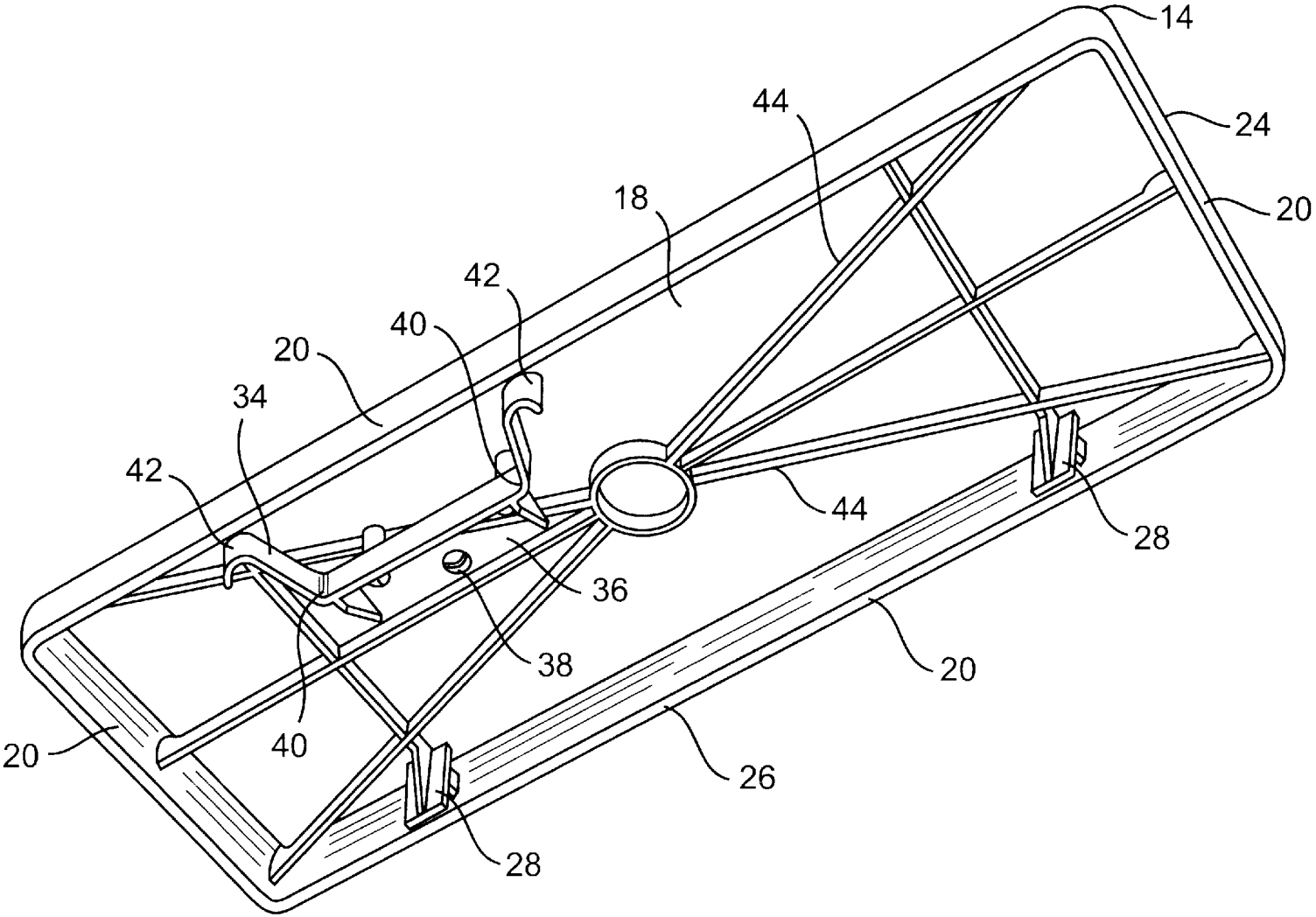
FIG. 3 is a perspective view of the underside of the inventive tank cover according to the invention.

As illustrated in FIG. 3, it is also preferred that resilient retaining device 32 is offset from a centerline transversing long sides 26 of cover 10. In this manner, assuming the spring arms apply the same radial compressive force, a twisting or tightening torque is still imparted to cover 10 due to the offset of device 32 from the centerline. This twisting torque adds an additional securing force to cover 10 to ensure that it remains positively seated on the toilet tank without twisting or wobbling.

It should be appreciated by those skilled in the art that various modifications and variations can be made in the present invention without departing from the scope or spirit of the invention. For example, the retaining device could also be disposed on the shorter sides of tank cover 10. Also, any number of post members 28 can be provided. The invention is also not limited to plastic materials, but encompasses any conventional material. It is intended that the present description cover such modifications and variations as come within the scope of the appended claims and their equivalents.

What is claimed is:

1. A lightweight replaceable toilet tank cover for closing an open side of a toilet tank defined by tank walls, comprising:

a base member having a top surface and a bottom surface, and a lip defined around sides thereof extending downwardly relative to said bottom surface;

at least two post members disposed on said bottom surface and set off from said lip a predetermined distance so that a tank wall of said toilet tank can fit between said post members and said lip;

a resilient retaining device disposed on said bottom surface adjacent and set off from said lip, said retaining device comprising at least two spring arms resiliently movable in a plane generally parallel to said bottom surface for resiliently pressing against an inside surface of a toilet tank wall thereby clamping said toilet tank wall between said lip and said spring arms.

2. The toilet tank cover as in claim 1, wherein said base member is formed of a plastic material.

3. The toilet tank cover as in claim 2, further comprising a plurality of stiffening members formed on said bottom surface.

4. The toilet tank cover as in claim 1, wherein said post members are disposed along a same side of said bottom surface, and said retaining device is disposed adjacent an opposite side of said bottom surface.

5. The toilet tank cover as in claim 1, wherein said spring arms are mounted at a pivot point to a rigid base member and are resiliently movable in a radial plane relative to said pivot point.

6. The toilet tank as in claim 5, wherein said spring arms comprise an arcuate face disposed to contact the toilet tank wall.

7. The toilet tank cover as in claim 1, wherein said retaining device is disposed offset from a centerline transversing long sides of said cover.

8. A lightweight replaceable toilet tank cover for closing an open side of a toilet tank defined by tank walls, comprising:

a plastic material base member having a top surface and a bottom surface, and a lip defined around sides thereof extending from said bottom surface;

at least two post members disposed on said bottom surface along a same side thereof and set off from said lip a predetermined distance; and a dual acting spring device disposed on said bottom surface adjacent and set off from said lip, and offset from a centerline traversing long sides of said cover said spring device comprising at least two spring arms pivotally mounted to a rigid base member fixed to said bottom surface, said spring arms resiliently movable in a radial plane generally parallel to said bottom surface and further comprising an arcuate tank contacting face for resiliently pressing against an inside surface of a toilet tank wall thereby clamping said toilet tank wall between said lip and said spring device.

* * * * *